US005299835A

United States Patent [19]

Sonnenberg

[11] Patent Number: 5,299,835

[45] Date of Patent: Apr. 5, 1994

[54] BUSINESS CARD NOTE PAPER

[76] Inventor: William H. Sonnenberg, 1801 S. Federal Hwy. #215, Delray Beach, Fla. 33483-3333

[21] Appl. No.: 20,827

[22] Filed: Feb. 19, 1993

Related U.S. Application Data

[63] Continuation-in-part of Ser. No. 762,336, Sep. 19, 1991, abandoned.

[51] Int. Cl.[5] ..... B42D 15/00

[52] U.S. Cl. ..... 253/56; 283/62; 283/117; 283/116; 283/106; 283/105

[58] Field of Search ..... 283/81, 105, 56, 106, 283/61, 116, 62, 117; 402/79; 281/2, 5

[56] References Cited

U.S. PATENT DOCUMENTS

| | | | |
|---|---|---|---|
| 892,675 | 7/1908 | Morrison | 283/116 |
| 1,330,730 | 2/1920 | Thompson | 283/56 |
| 1,417,211 | 5/1922 | Shurick | 283/56 |
| 1,612,240 | 12/1926 | Uptegraff | 283/56 |
| 2,135,331 | 11/1938 | Doolittle | 283/56 |
| 2,277,596 | 3/1942 | Lichter | 283/56 |
| 2,321,184 | 6/1943 | Butterworth | 283/81 |
| 2,616,612 | 11/1952 | Guttman | 283/56 |
| 4,272,327 | 6/1981 | Logan | 283/81 X |
| 4,722,554 | 2/1988 | Pettit | 283/105 |
| 4,838,580 | 6/1989 | Tuhkanen | 283/56 |
| 4,957,311 | 9/1990 | Geisenheimer | 283/56 |
| 4,962,950 | 10/1990 | Champion | 283/67 |

*Primary Examiner*—Paul A. Bell

*Attorney, Agent, or Firm*—Oltman and Flynn

[57] ABSTRACT

A promotional note page includes a first page portion having space for writing notes, a second page portion in the form of a business card, and a separation line for separating the first page portion from the second page portion. Letterhead notation along at least one edge of the first page portion is preferably provided. The line of separation is preferably a series of perforations. At least one flap portion may be provided, having a line of separation for separating and/or folding the flap portion from the rest of the note page. The line of separation is preferably a series of perforations. At least one line may be provided on the first portion to guide handwriting thereon. Alternatively, at least one stripe on the first portion to guide handwriting on it may be provided. Another option is at least one tab portion which can be folded over to increase thickness for securing a fastener and for aiding alignment of an attachment.

11 Claims, 7 Drawing Sheets

BUSINESS CARD NOTE PAPER

FILING HISTORY

This application is a continuation-in-part of application Ser. No. 07/762,336, filed on Sept. 19, 1991, abandoned.

BACKGROUND OF THE INVENTION

1. Field of the Invention

The present invention relates generally to the field of promotional stationery items, and more specifically to a note page having an aesthetically combined, detachable business card.

2. Description of the Prior Art

There have long been stationery items marked with the sender's business name and address. While most of these items are helpful in advertising, none combines an independently useful portion with a detachable portion which would likely be saved for future reference.

One such prior item is that of Thompson, U.S. Pat. No. 1,330,730, issued on Feb. 10, 1920. Thompson teaches a billhead with a lined, detachable top portion on which the addressee writes his name and address. A gummed edge portion detachable from the top portion contains the sender's name and address. The recipient completes the top portion and returns it with a check for the amount of the bill. The gummed edge portion can be affixed to an envelope to save the trouble of addressing the envelope and to assure that it is addressed correctly. The addressee keeps the lower portion for his files. A problem with Thompson is that, although the sender's name and address are provided on the sheet, these are not provided on parts that would be saved to generate future business.

Doolittle, U.S. Pat. No. 2,135,331, issued on Nov. 1, 1938, discloses an advertising booklet. This booklet includes a front cover in the form of a business card, attached to the booklet along a perforated edge. The pages of the booklet have advertising information on them. A problem with Doolittle is that it is not stationery, or any other useful item apart from its advertising purpose. Thus the recipient is likely to discard the booklet.

Lichter, U.S. Pat. No. 2,277,596, issued on Mar. 24, 1942, teaches a combination blotter and post card. An optional, detachable coupon tab is provided. Here again, the user will not likely wish to retain the blotter once it is used, and will typically dispose of the entire item. The recipient would normally relinquish the coupon to use it, and thus be left with no permanent reminder of the supplying company.

Guttman, U.S. Pat. No. 2,616,612, issued on Nov. 4, 1952, provides a mailing card with advertising space. A portion of the card is detachable and can be used to obtain credit or other accommodation. Again, the detachable portion is not part of something which would likely be retained as a whole.

Pettit, U.S. Pat. No. 4,722,554, issued on Feb. 2, 1988, teaches a sheet of paper having a check or other negotiable instrument printed on one side and coupons printed on the other. If the holder tears the coupons away, the check is destroyed, and if he uses the check, he looses the coupons. This device is intended to provide alternative offers to the holder, only one of which can be selected. A problem with Pettit is that nothing remains to remind the holder of the sender once the sheet of paper is redeemed.

Tuhkanen, U.S. Pat. No. 4,838,580, issued on Jun. 13, 1989, discloses a combined advertising brochure and business card. Again, there is no reason for most recipients to retain any of the item. The entire item serves the recipient only as an advertisement.

Versage, U.S. Pat. No. 4,907,826, issued on Mar. 13, 1990, illustrates a greeting card containing a business related message. While a pleasant thought, this card would no doubt suffer the fate of most greeting cards at the end of the holiday or other occasion.

Geisenheimer, U.S. Pat. No. 4,957,311, issued on Sept. 18, 1990, teaches an article of advertising mail divided into a reply postcard and an index card. It is desired that the recipient of the item separate and keep the index card. However, the fact that the entire item is an advertisement may lead to prompt disposal together with the remainder of bulk advertising mail.

Champion, U.S. Pat. No. 4,962,950, issued on Oct. 16, 1990 discloses a combination entrance ticket and wagering coupon for parimutuel events. Once again, once the recipient redeems these portions, nothing remains to remind him of the sender.

It is thus an object of the present invention to provide a combination stationery item which has at least one portion which is useful to the recipient apart from being an advertisement or promotion.

It is another object of the present invention to provide a business card note sheet having two page portions, the first page portion having a writing space comprising at least half of the area of one side of the sheet and providing space for writing notes, and the second page portion defining a business card.

It is another object of the present invention to provide such an item which has a portion the recipient can conveniently retain to remind him of the sender.

It is finally an object of the present invention to provide such an item which is pleasing in appearance and reasonably inexpensive to produce.

SUMMARY OF THE INVENTION

The present invention accomplishes the above stated objectives, as well as others, as may be determined by a for reading and interpretation of the entire specification.

A promotional note page is provided which includes a first page portion having space for writing notes, a second page portion in the form of a business card, and a separation line for separating the first page portion from the second page portion. The first page portion comprises at least half of the area of the page and provides space at least half the area of the page for writing notes. The second page portion defines a business card. Letterhead notation along at least one edge of the first page portion is preferably provided. The line of separation is preferably a series of perforations. At least one flap portion may be provided, having a line of separation for separating and/or folding the flap portion from the rest of the note page. The line of separation is preferably a series of perforations. At least one line may be provided on the first portion to guide handwriting thereon. Alternatively, at least one stripe on the first portion to guide handwriting on it may be provided. Another option is at least one tab portion which can be folded over to increase thickness and guide attachment of a fastener.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
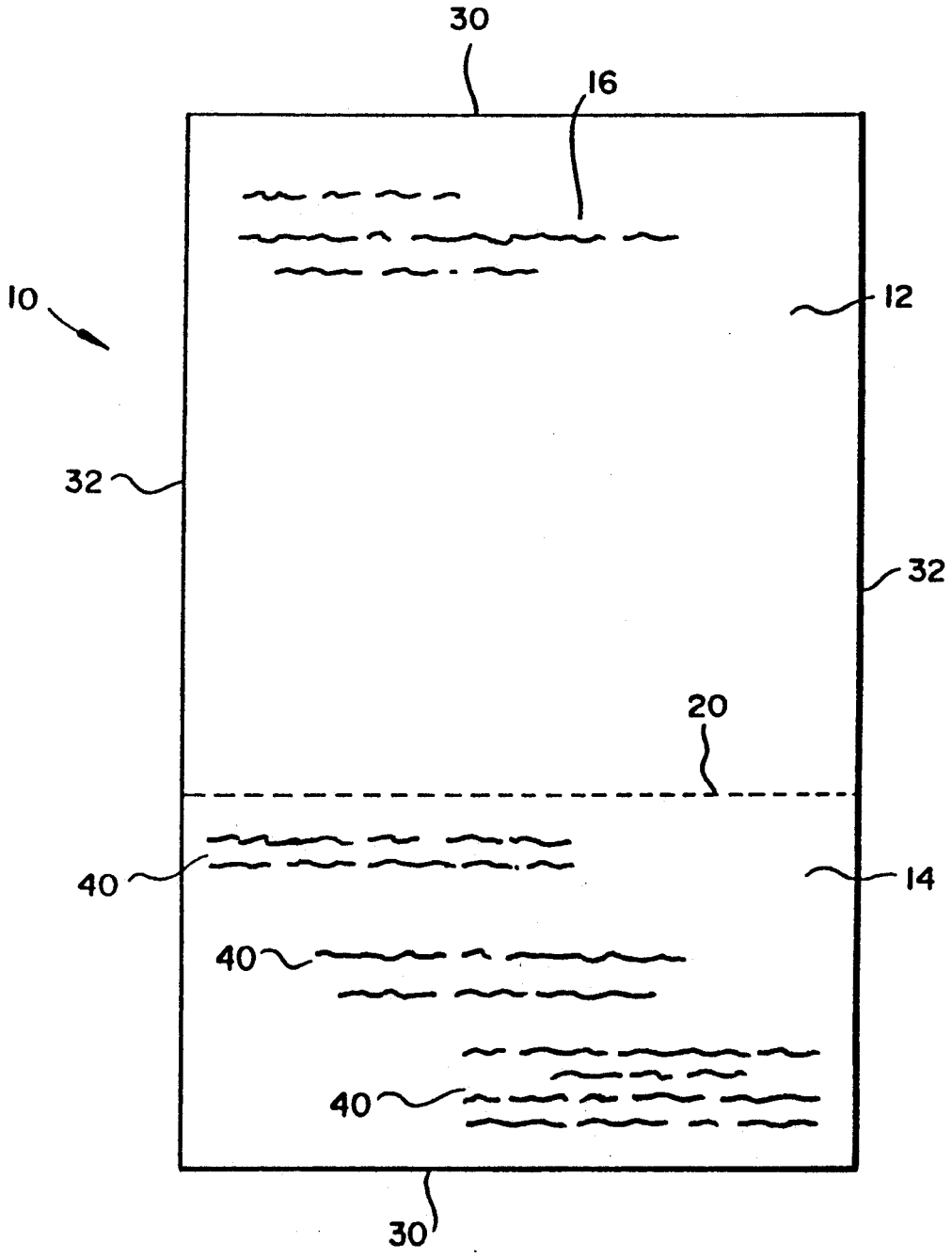
FIG. 1 is a plan view of the first preferred embodiment, showing a business card removably attached to the lower edge of a note page.
Figure 2:
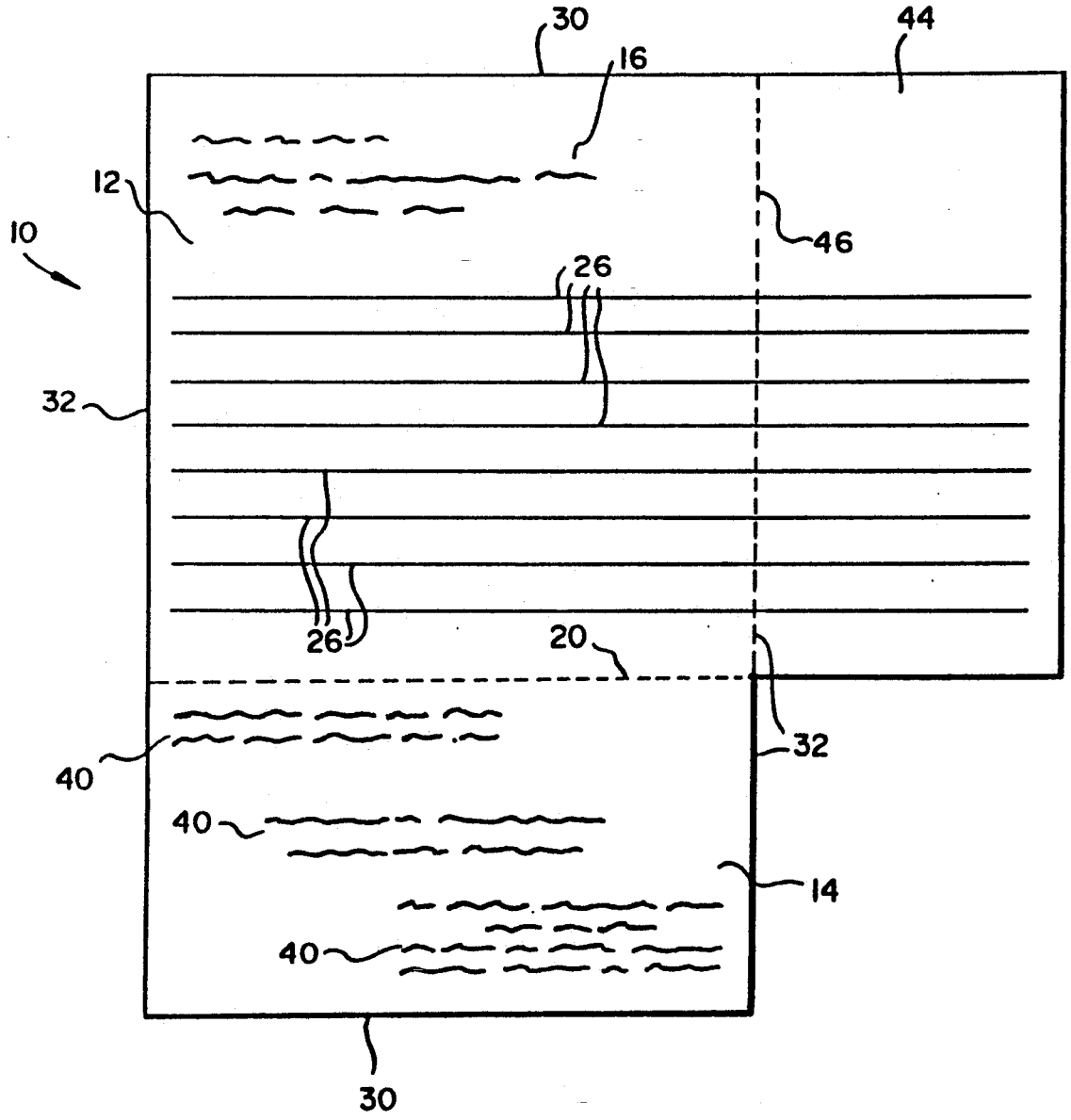
FIG. 2 is a plan view of the second preferred embodiment, which adds a removable and foldable flap for additional writing space.
Figure 3:
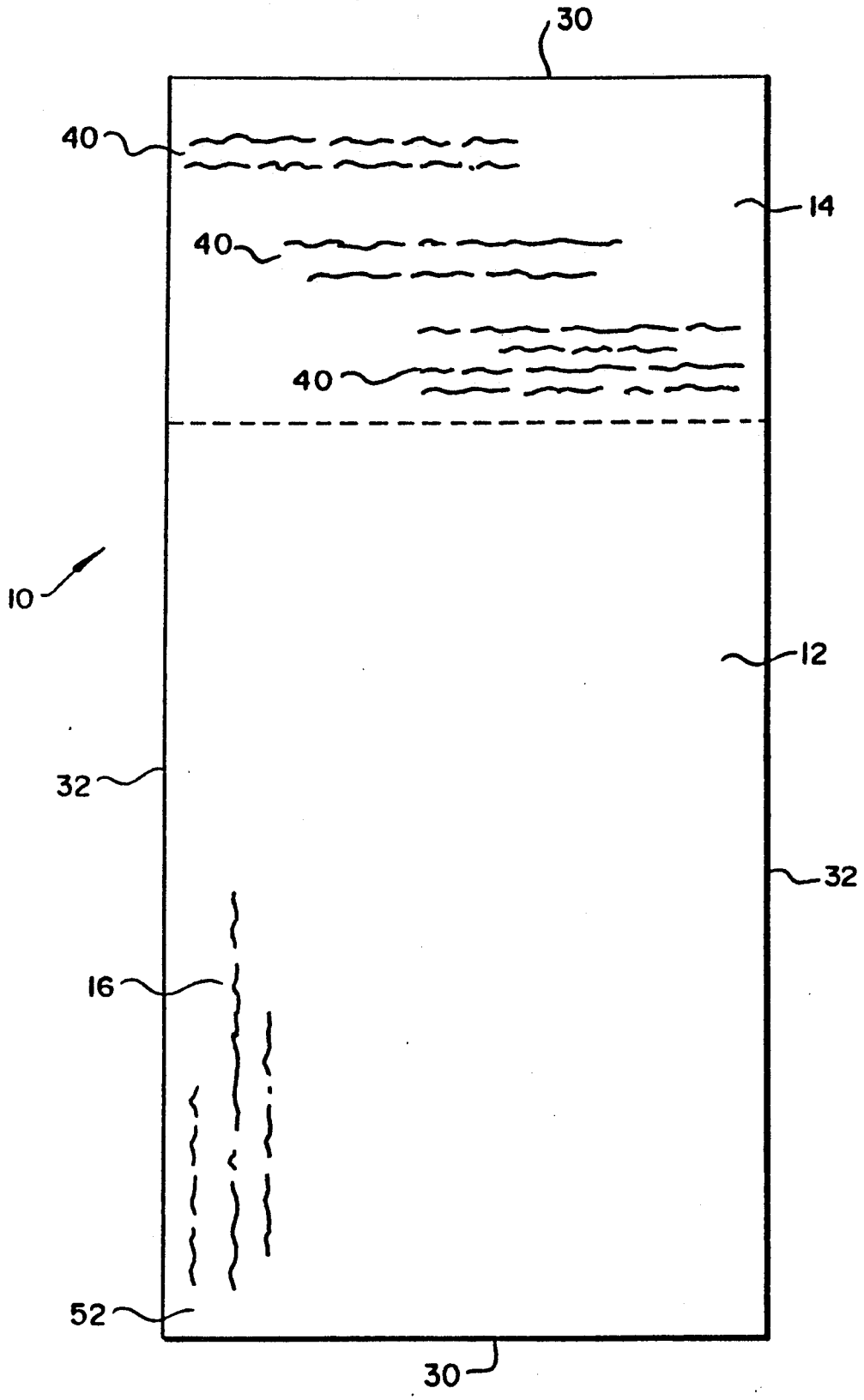
FIG. 3 is a plan view of the third preferred embodiment, illustrating an alternative type and letterhead orientation.
Figure 4:
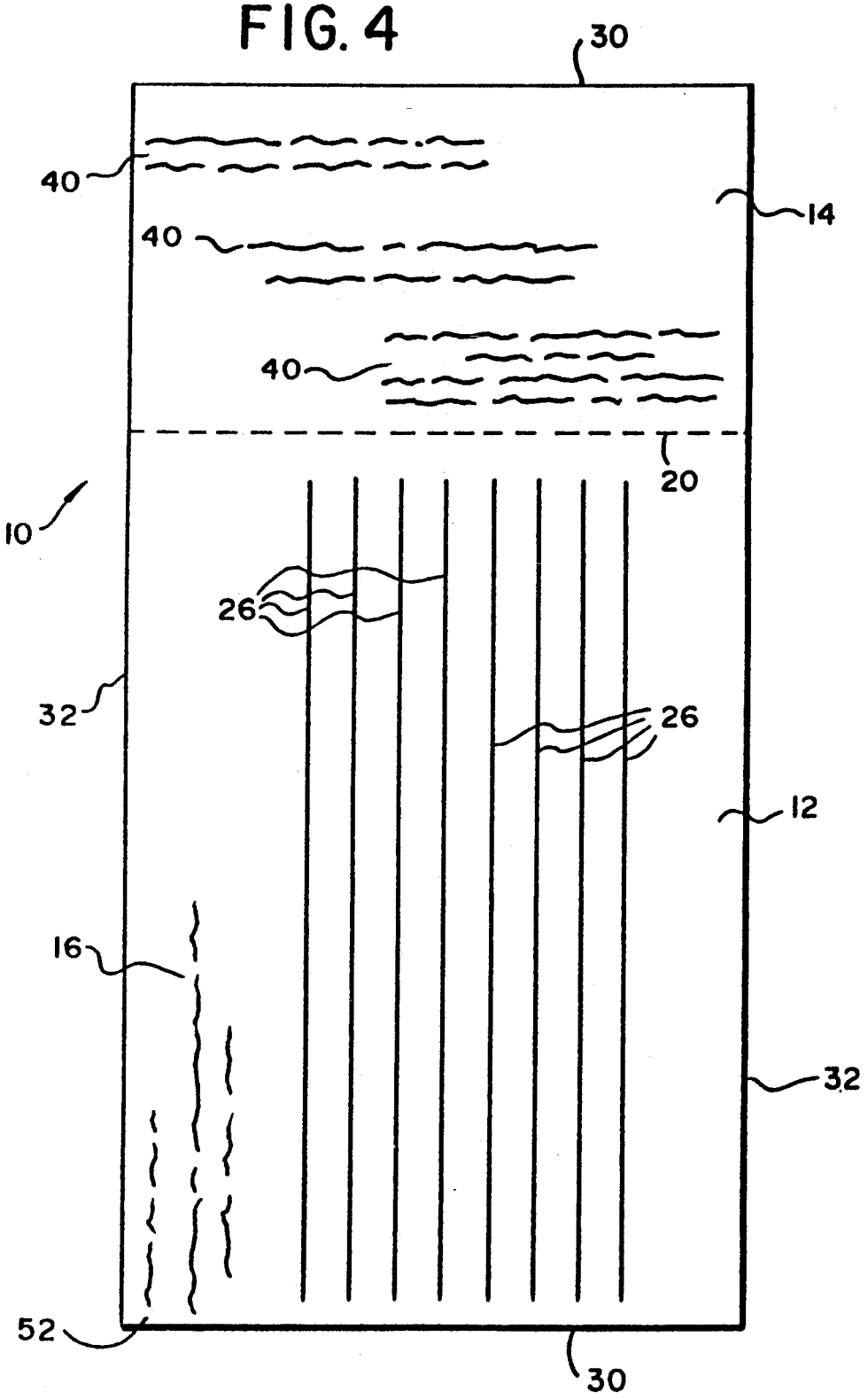
FIG. 4 is a plan view of the fourth preferred embodiment, illustrating handwriting guide lines.
Figure 5:
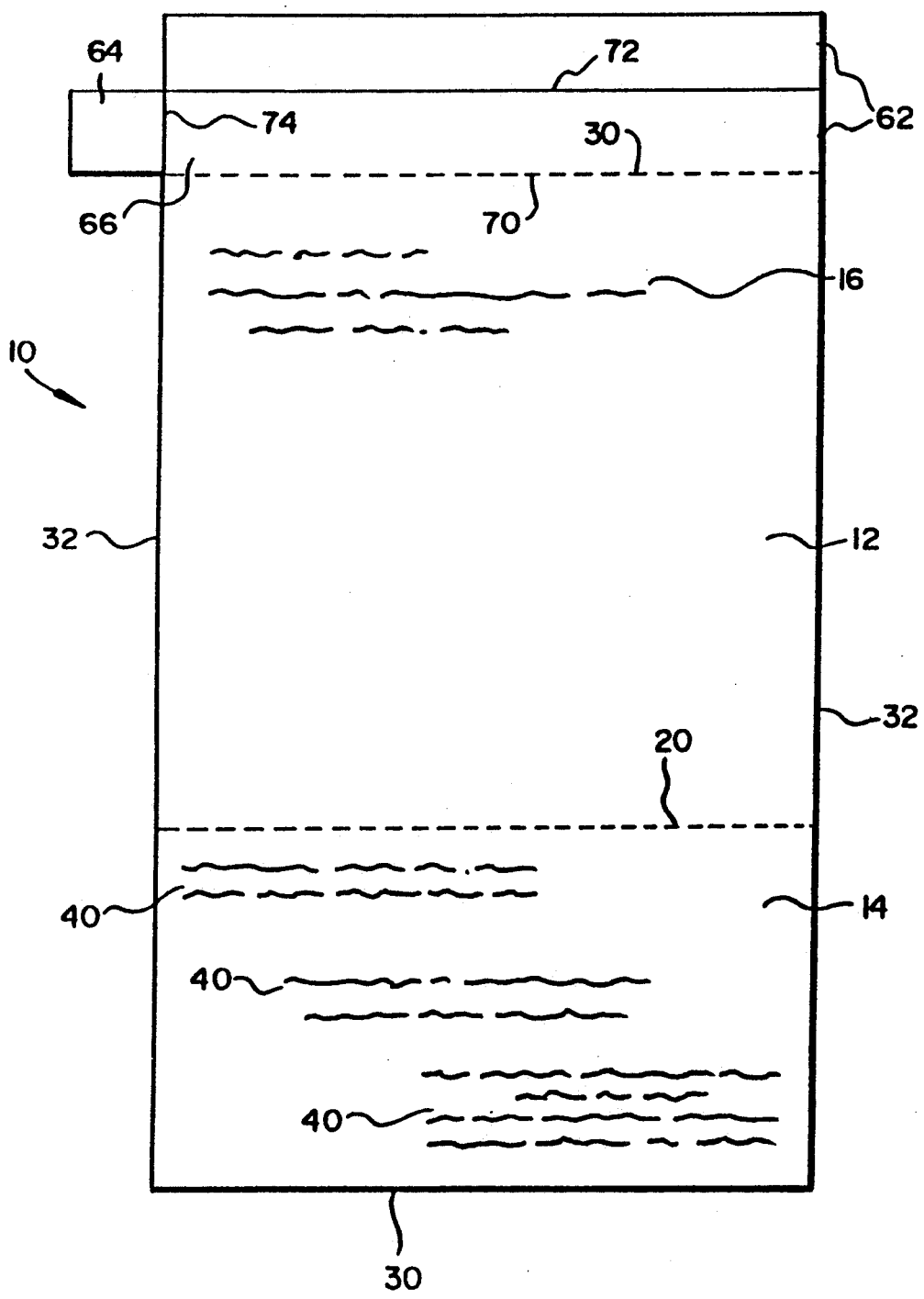
FIG. 5 is a plan view of the fifth preferred embodiment, illustrating the removable tab and strip which can be folded over to increase thickness for more secure attachment of fasteners.
Figure 6:
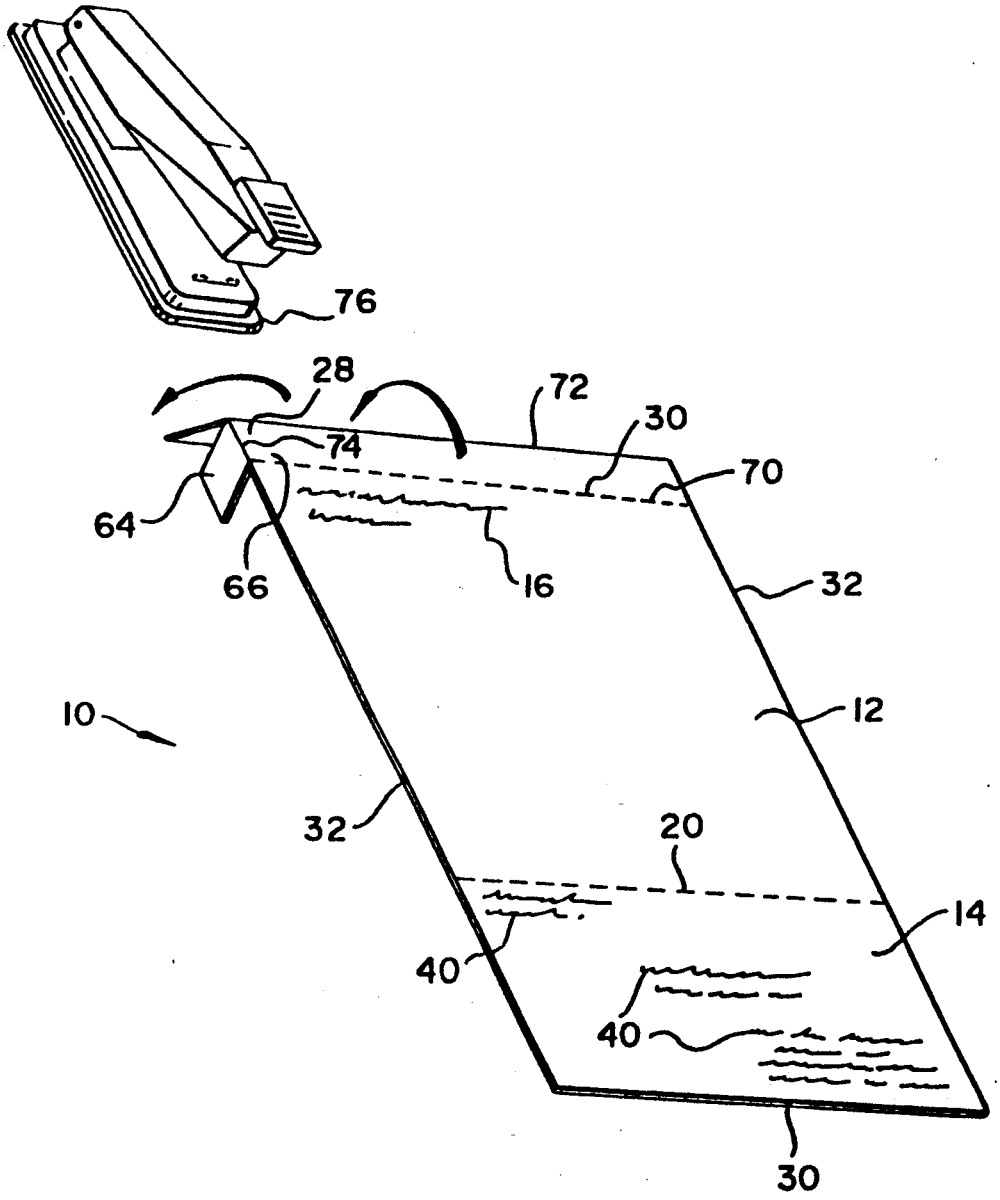
FIG. 6 is a perspective view of the fifth preferred embodiment, illustrating the folding of the tab and strip.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

PREFERRED EMBODIMENTS

Referring to FIGS. 1–6, a sheet 10 is disclosed having a note portion 12 and a detachable business card portion 14. Note portion 12 has a writing space comprising at least half of the area of one side of sheet 10 and providing a space for writing notes. Letterhead 16 is printed along an edge of note portion 12. Business card portion 14 is divided from note portion 12 area by at least one line of perforations 20, along which a tear can easily be made. Lines 26 or alternating colored or shaded stripes are preferably provided to guide handwriting. Sheet 10 is preferably sized to fit, if necessary, within a standard, number ten envelope so that it can be enclosed with correspondence to recipients. Since business card portion 14 is integrally formed with sheet 10, business card portion 14 cannot be lost or go unrecognized in the envelope. Perforations 20 also permit portion 14 to be folded back to fit into the envelope, thereby permitting the area of note portion 12 to be increased. The preferred sheet 10 material is light card paper of a weight similar to cover stock.

FIRST PREFERRED EMBODIMENT

Sheet 10 of the first preferred embodiment is rectangular, having short edges 30 equal to the length of a standard business card and long edges 32 which are about twice the length of short edges 30. See FIG. 1. Line of perforations 20 extends parallel to short edges 30, at a distance from the bottom of sheet 10 equal to the width of a standard business card. The type 40 on card portion 14 is oriented to be read when card portion 14 is located at the bottom of sheet 10. For this embodiment, letterhead 16 is oriented to match type 40 on card portion 14. Letterhead 16 is located along short edge 30 at the top of sheet 10. Letterhead 16 preferably begins with the words "From the desk of". On the top one-quarter to one-half inch of sheet 10 in FIG. 1, there can be adhesive for attachment to correspondence instead of a paper clip.

SECOND PREFERRED EMBODIMENT

The second preferred embodiment is like the first except that a detachable flap portion 44 extends from the right long side 32. See FIG. 2. A second line of perforations 46 divides note portion 12 from flap portion 44. Several optional, parallel writing lines 26 are illustrated extending from the left long edge 32 across second line of perforations 46 and across flap portion 44. The purpose of flap portion 44 is to provide additional writing space. Second line of perforations 46 permits removal of flap portion 44 when not needed, and also permits folding flap portion 44 over to fit sheet 10 into a standard envelope. A similar flap portion could be provided at the left long edge 32 either additionally or alternatively to flap portion 44 on the right long edge 32.

THIRD PREFERRED EMBODIMENT

The third preferred embodiment is like the first except that letterhead 16 on note portion 12 is positioned at the lower left corner 52 of sheet 10, to be read when sheet 10 is rotated clockwise by ninety degrees. See FIG. 3.

FOURTH PREFERRED EMBODIMENT

The fourth preferred embodiment is like the third, except that writing lines 26 are provided. See FIG. 4. Lines 26 extend parallel to long edges 32, from a border about one quarter inch from card portion 14 to a border about one quarter inch from opposing short edge 30.

FIFTH PREFERRED EMBODIMENT

The fifth preferred embodiment is like the first, with the addition of an edge strip 62 along the top edge 30 and a tab 64 at the lower left edge 66 of edge strip 62. See FIG. 5. A line of perforations 70 separates edge strip 62 from note portion 12. A crease 72 longitudinally divides edge strip 62. Another crease 74 divides tab 64 from edge strip 62. Either or both the upper portion of edge strip 62 and tab 64 can be folded over to create a composite thickness which is double or triple that of sheet 10 itself. See FIG. 6. This added thickness at the top of sheet 10 permits the firm application of a paper clip or staple 76. Should this feature prove to be unneeded in a given instance, line of perforations 70 permits neat removal of edge strip 62 and tab 64 by tearing. Edge strip 62 and tab 64 also serve to create a corner pocket 28 to help guide attachment and retain a paper mailed with sheet 10.

Figure 7:
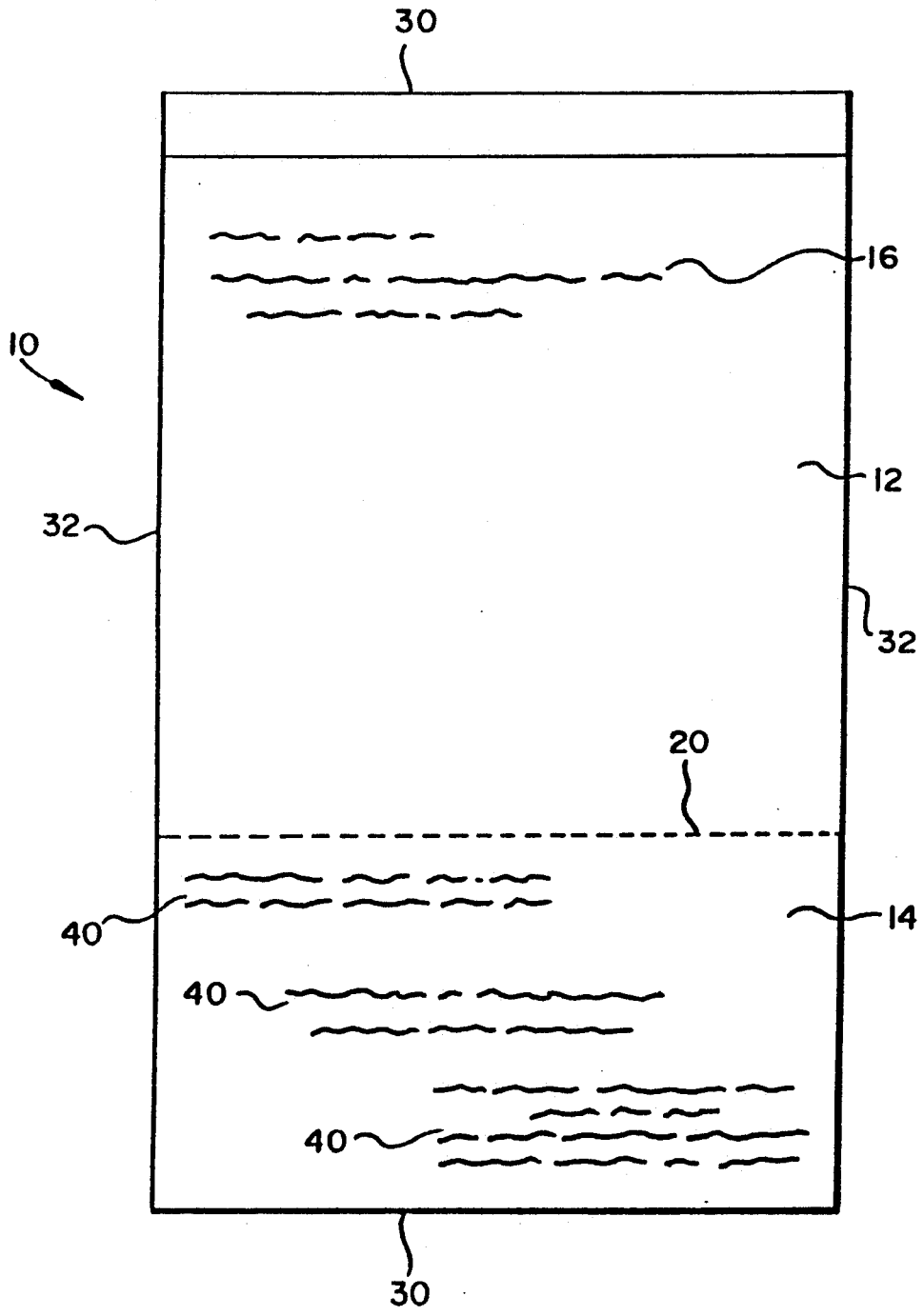
FIG. 7 is a plan view of the inventive note card of FIG. 1, showing the adhesive feature.

An adhesive 80 for attaching items may be provided on sheet 10. Adhesive 80 preferably extends along or near a sheet 10 edge, such as top edge 30, as shown in FIG. 7.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A promotional note page comprising:

a rectangular sheet having a first page edge essentially equivalent in length to the length of a conventional business card, and having two opposing side edges intersecting said first edge, separation means parallel to said first edge and extending from one said side edge to the other said side edge, thereby dividing said rectangular sheet into a first page portion and a second page portion, said separation means being spaced from said first edge a distance essentially equivalent to the width of a conventional business card, said first page portion having a writing space comprising at least half of the area of one side of said sheet and providing space for writing notes, said second page portion defining a business card.

2. A promotional note page as in claim 1, additionally comprising letterhead notation along at least one edge of the first page portion.

3. A promotional note page as in claim 1, wherein the separation means is a series of perforations.

4. A promotional note page as in claim 1, additionally comprising at least one flap portion and separation means for dividing the flap portion from the rest of the note page.

5. A promotional note page as in claim 4, wherein the separation means is a series of perforations.

6. A promotional note page as in claim 1, additionally comprising at least one line on the first portion to guide handwriting thereon.

7. A promotional note page as in claim 1, additionally comprising at least one stripe on the first portion to guide handwriting thereon.

8. A promotional note page as in claim 1, additionally comprising at least one tab portion extending from said first page portion which can be folded over to increase thickness for attachment of a fastener and to guide alignment during fastener attachment.

9. A promotional note page as in claim 1 having at least one edge, additionally comprising a strip along said at least one edge which can be folded over to increase thickness for attachment of a fastener and to guide alignment during fastener attachment.

10. A promotional note page as in claim 1, having a plurality of edges, additionally comprising adhesive near at least one of said edges for ready attachment of at least one item.

11. A promotional note page comprising:

a rectangular sheet having a first edge essentially equivalent in length to the length of a conventional business card, and having two opposing side edges intersecting said first edge, separation means parallel to said first edge and extending from one said side edge to the other said side edge thereby dividing said rectangular sheet into a first page portion and a second page portion, said separation means being spaced from said first edge a distance essentially equivalent to the width of a conventional business card, said first page portion providing space for writing notes and brief correspondence, said second page portion defining a business card, at least one tab portion extending from said first page portion which can be folded over to increase thickness for attachment of a fastener and to guide alignment during fastener attachment.

* * * * *